US005613833A

United States Patent [19]

Wolfe et al.

[11] Patent Number: 5,613,833

[45] Date of Patent: Mar. 25, 1997

[54] QUICK RELEASE TILT ADJUSTMENT MECHANISM

[75] Inventors: Robert E. Wolfe, Holliston; Johnson Hsu, Framingham, both of Mass.

[73] Assignee: Holmes Products Corp., Milford, Mass.

[21] Appl. No.: 550,157

[22] Filed: Oct. 30, 1995

[51] Int. Cl.[6] ..... F04D 29/60

[52] U.S. Cl. ..... 416/246; 416/247 R

[58] Field of Search ..... 416/244 R, 246, 416/247 R; 248/292.13

[56] References Cited

U.S. PATENT DOCUMENTS

| | | | |
|---|---|---|---|
| D. 147,417 | 9/1947 | Palma, Jr. . | |
| D. 346,653 | 5/1994 | Chiu et al. . | |
| 2,390,299 | 12/1945 | Gutkin | 416/244 |
| 2,904,298 | 9/1959 | Tateishi | 416/244 |
| 2,954,198 | 9/1960 | Lindberg et al. | 416/246 |
| 3,963,382 | 6/1976 | Patton . | |
| 4,515,538 | 5/1985 | Shih | 416/246 |
| 5,002,462 | 3/1991 | Janisse . | |
| 5,052,262 | 10/1991 | Havens . | |
| 5,383,716 | 1/1995 | Stewart et al. . | |
| 5,429,481 | 7/1995 | Liu | 416/247 R |
| 5,431,544 | 7/1995 | Hsu et al. | 416/247 R |
| 5,435,696 | 7/1995 | Cunning | 416/246 |
| 5,492,296 | 2/1996 | Biber | 248/292.13 |

FOREIGN PATENT DOCUMENTS

| | | | |
|---|---|---|---|
| 0191697 | 8/1987 | Japan | 416/246 |

*Primary Examiner*—Edward K. Look
*Assistant Examiner*—Mark Sgantzos
*Attorney, Agent, or Firm*—Hoffmann & Baron

[57] ABSTRACT

A support particularly adapted to support an electric fan is provided. The support has a cam action quick release mechanism which is movable between locked and free positions. When the release mechanism is in the free position the fan can be easily rotated to a desired degree of tilt about a horizontal axis. When the release mechanism is in the locked position rotation of the fan is prevented. The support also includes tilt limiting mechanisms which sets a predetermined forward and backward limitation on fan rotation.

14 Claims, 5 Drawing Sheets

QUICK RELEASE TILT ADJUSTMENT MECHANISM

BACKGROUND OF THE INVENTION

1. Field of the Invention

The present invention relates to supports. More specifically, it relates to a fan support having a quick release mechanism to facilitate adjustment of the angle of tilt of an electric fan.

2. Description of the Prior Art

As will be seen, the simplicity and effectiveness of my invention is not rivaled in the prior art.

U.S. Pat. No. 5,002,462, issued to Janisse on Mar. 26, 1991, shows a fan guard having a quick mount mechanism. The mechanism allows for quick removal of the fan guard. By contrast, the device of the instant invention provides a tilt adjustment mechanism in which the desired angle of tilt may be effectively and quickly achieved.

U.S. Pat. No. 5,052,262, issued to Havens on Oct. 1, 1991, shows a cymbal tilt adjustment mechanism. The mechanism has a main body with a threaded axially movable actuator disposed therein having an integral handle, the actuator being connected to a sliding block which contains a contacting member which causes the cymbal to tilt in response to turning of the actuator handle. By contrast, the device of the instant invention provides a tilt mechanism having a quick release mechanism which is movable between a first or locked position where the tilt angle of the fan cannot be adjusted, and a second position allowing for free movement of the fan to the desired angle of tilt.

U.S. Pat. No. 5,383,716, issued to Stewart et al. on Jan. 24, 1995, shows a quick release axle attachment for a vehicle wheel. A spring loaded cam actuated assembly is movable between locked and free positions. When in the free position the wheel can be removed. By contrast, the device of the instant invention contemplates a quick release mechanism where the mechanism is movable between locked and free positions, the fan or other article to be supported being free to tilt or rotate on an axis when the mechanism is in the free position and being locked in position when the mechanism is in the locked position.

U.S. Pat. No. 3,963,382, issued to Patton on Jun. 15, 1976, shows a fan support which allows for free rotation or tilting of the fan on a horizontal axis. The support allows for almost 360° rotation. By contrast, the device of the instant invention allows for tilting of the fan only when the quick release mechanism is in the free position. A tilt limiting mechanism limits the rotation of the fan when the quick release mechanism is in the free position.

U.S. Pat. No. Des. 346,652 issued to Chiu et al. on May 3, 1994, shows a support for a high velocity fan. The support appears to have a tilt limiting mechanism but does not appear to have a quick release mechanism or means for maintaining the desired angle of tilt. By contrast, the instant invention contemplates a support having both a means for releasably maintaining the desired angle of tilt and a tilt limiting mechanism.

It will be noted that none of the prior art devices shows a support having a quick release mechanism which allows for selective rotation of the article to be supported between predetermined limit stops.

None of the above inventions and patents, taken either singly or in combination, is seen to describe the instant invention as claimed.

SUMMARY OF THE INVENTION

Briefly, the invention comprises a support particularly adapted to support an electric fan. The support has a cam action quick release mechanism which is movable between locked and free positions. When the release mechanism is in the free position the fan can be rotated to a desired degree of tilt about a horizontal axis. When the release mechanism is in the locked position, rotation of the fan is prevented. The support also includes a tilt limiting mechanism which sets a predetermined forward and backward limitation on fan rotation.

Accordingly, it is a principal object of the invention to provide a new and improved support device which overcomes the disadvantages of the prior art in a simple but effective manner.

It is a major object of this invention to provide a quick release mechanism for a fan support which allows for quick and easy adjustment of the angle of tilt of the fan.

It is another object of the invention to provide such a release mechanism which is capable of maintaining the set angle of tilt.

It is another object of the invention to provide a support for a fan which allows for adjustment of the angle of tilt between predetermined backward and forward limits.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
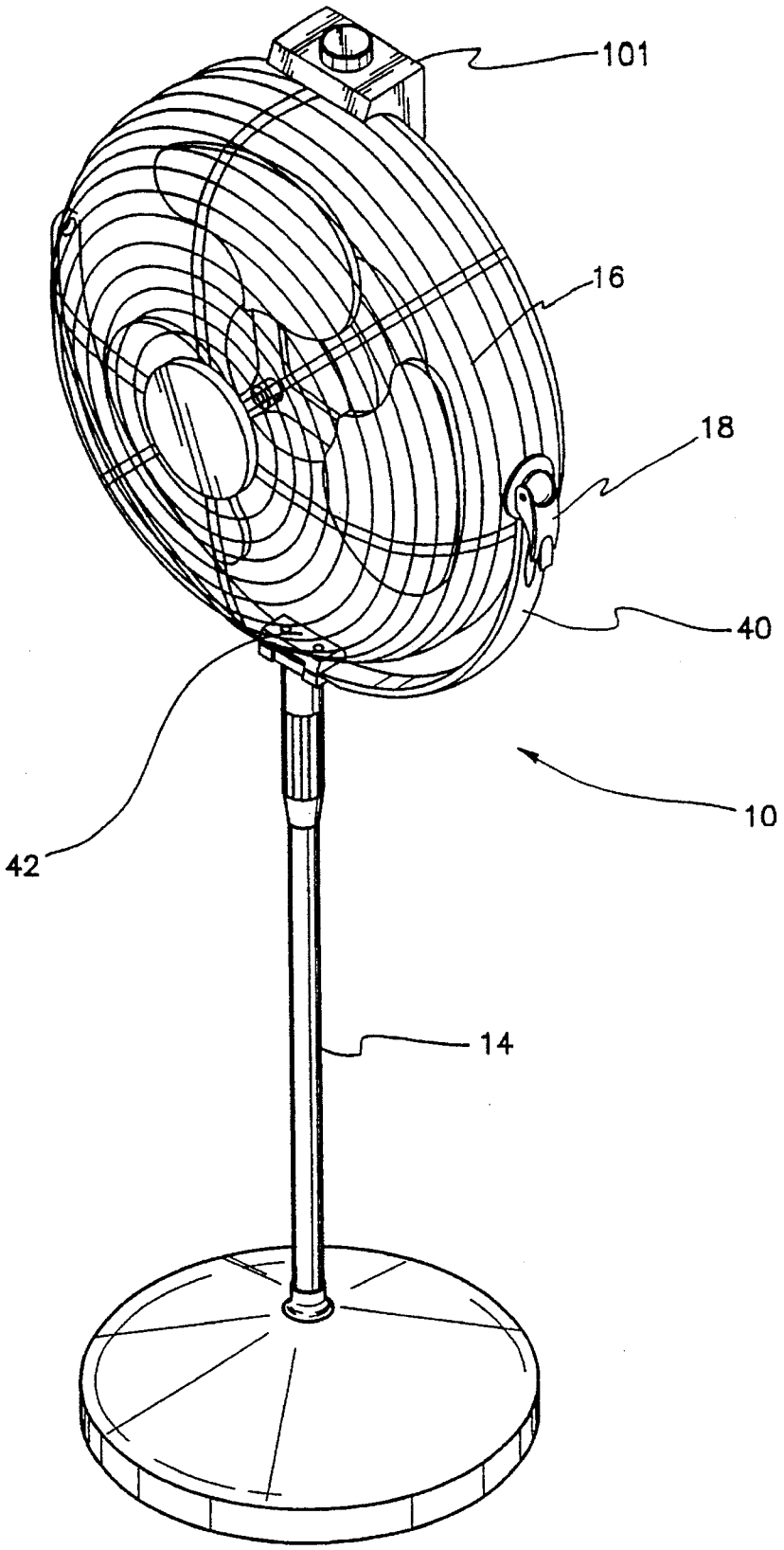
FIG. 1 is an environmental perspective view of the support of the present invention attached to an electric fan.

Referring now to FIG. 1 a perspective view of the support of the present invention, generally designated by the numeral 10 is shown. The support 10 can be connected to an adjustable pole assembly 14 as shown in FIG. 1 or a base suitable for table top or floor placement not shown. The support 10 allows for selective rotation of the fan 16 or other article to be supported to a desired angle of tilt. Once the desired angle of tilt is obtained the fan 16 can be locked into position using the quick release mechanism 18 of the present invention 10. The control module 101 is mounted on the top and limits rotation of fan housing through the U-shaped support bracket 40.

Figure 2:
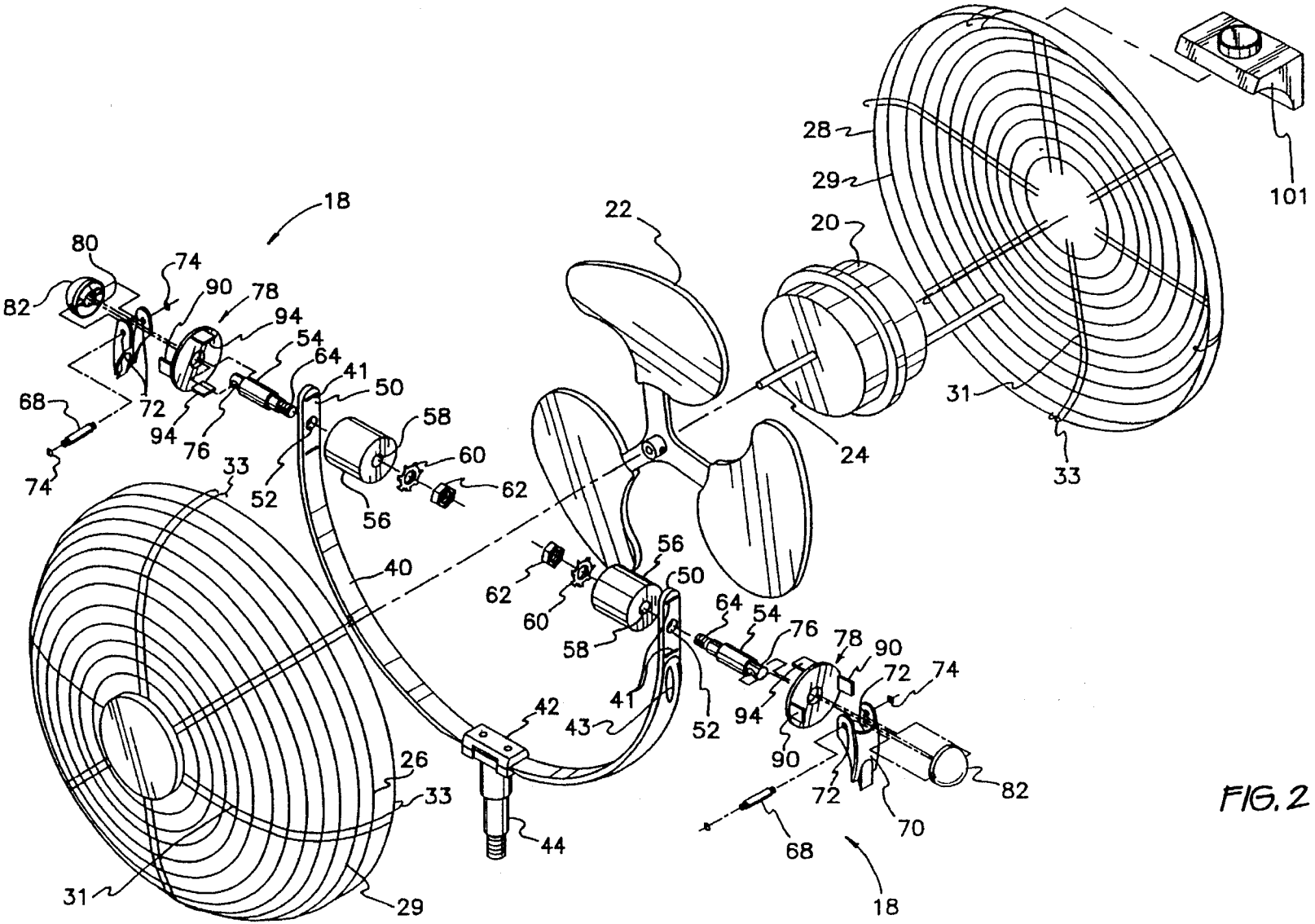
FIG. 2 is an exploded perspective view of the support detailing the quick release mechanism.

The adjustable pole assembly 14 is described in pending U.S. application Ser. No. 08/418,611 filed on Apr. 7, 1995 which is herein incorporated by reference. The quick release mechanism 18 as shown in FIG. 1 is connected to a U-shaped support bracket 40, the U-shaped support bracket 40 being connected to a clamp 42 having an integral bayonet or screw connector 44 as shown in FIG. 2 extending downwardly therefrom for connection to the pole assembly 14. Alternatively, the clamp 42 and integral connector 44 as shown in FIG. 2 may be replaced with means for oscillation about a vertical or horizontal axis (not shown).

Referring again to FIG. 2 the quick release mechanism 18 is shown in greater detail. The mechanisms are mounted in mutually opposed relation on opposite ends of the U-shaped bracket 40. The ends 50 of the bracket 40 are expanded in width and have circular apertures 52 formed therein to allow for passage of a post 54 therethrough and slotted apertures 41 formed therein to key in friction plate 78. The post 54 extends through an annular compression member 56 having a central bore 58, a lock washer 60, and a nut 62. The post 54 has a threaded distal end 64 for threaded engagement within the nut 62. A centrally located transverse bore 76 formed in the post 54 allows for passage of a pin 68 through the post 54 to effect axial movement of the post 54 when lever 70 is pivoted as will be explained later. The lever has axially aligned apertures 72 and retaining rings 74 within which opposite ends of the pin 68 are secured. The proximal end of the post 54 is inserted through a friction plate 78 and secured in a hollow connector 80 formed in cap 82. Friction plate 78 has two oppositely placed, inward directed tabs 94 which fit into slots 41 on U-shaped bracket 40 to prevent it from rotating with the fan housing 16. Friction plate 78 also has two oppositely placed outward directed tabs 90 to prevent rotation of lever 70. Rotation of the fan housing 16 is further limited by the size and position of the control housing 101 which is too large to pass within the U-shaped support bracket 40.

Support bracket 40 has a contoured region 43 at its terminal ends to allow for placing fingers under the lever 70.

Figure 2B:
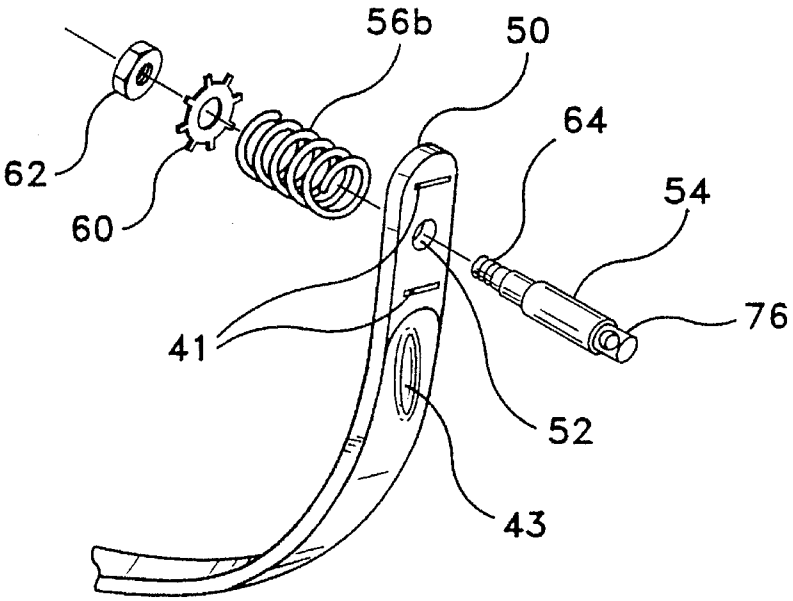
FIG. 2*b* is a detail of FIG. 2 showing another alternative embodiment wherein the compression member is a coiled compression spring.
Figure 2A:
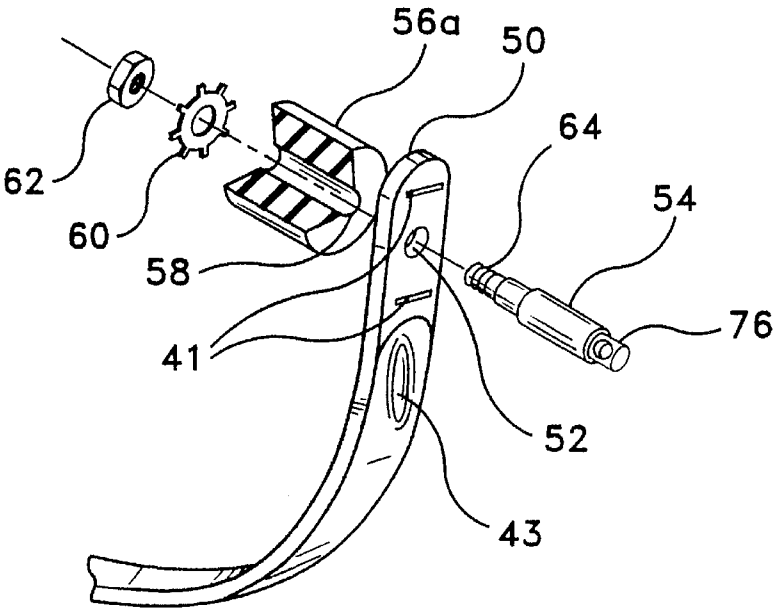
FIG. 2*a* is a detail of FIG. 2 showing an alternative embodiment wherein the compression member is formed from an elastomeric material.
Figure 2D:
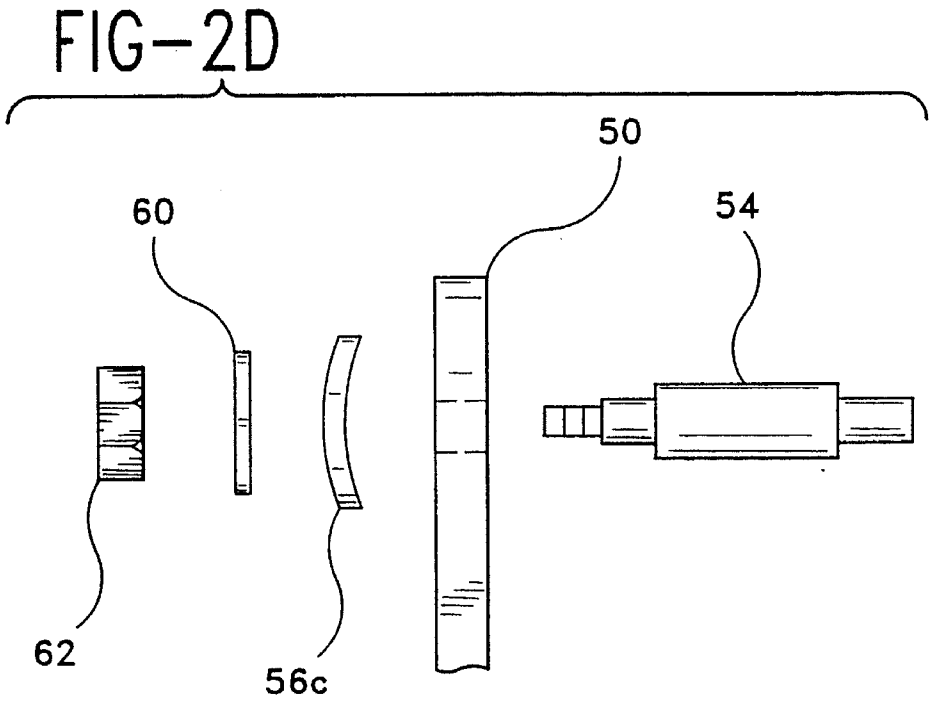
FIG. 2*d* is another view of the embodiment of FIG. 2*c*.
Figure 2C:
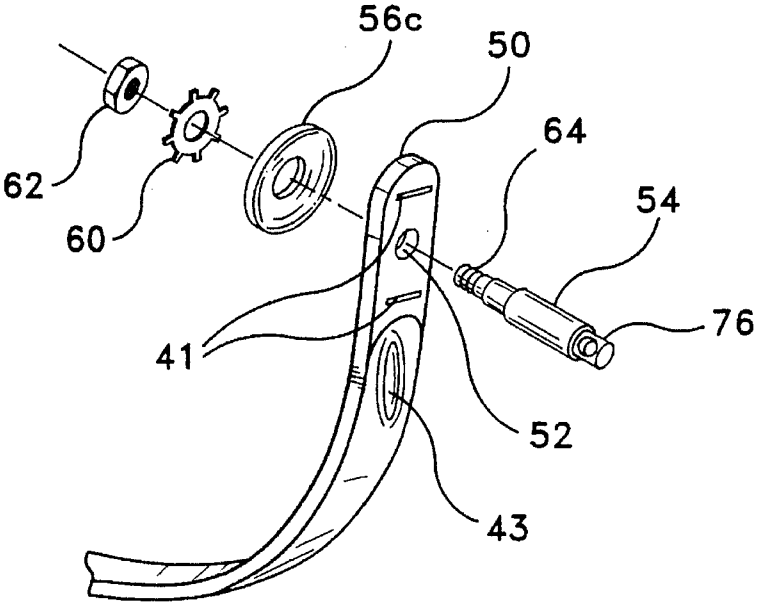
FIG. 2*c* is a detail of FIG. 2 showing still another alternative embodiment wherein the compression member is a flat compression spring.

When assembled, compression members 56 secure the outermost ribs 29 of the rear grill 28 with sufficient force to support the weight of the fan 16. In FIG. 2 the compression members are shown as cylinders and in the preferred embodiment are comprised of an elastomeric material (compression member 56*a* show in FIG. 2*a*) as rubber or elastomeric plastics. Alternatives to this are compression springs of either the coiled (compression member 56*b* shown in FIG. 2*b*) or flat compression member 56*c* shown in FIG. 2*c* and FIG. 2*d*) types.

Figure 3:
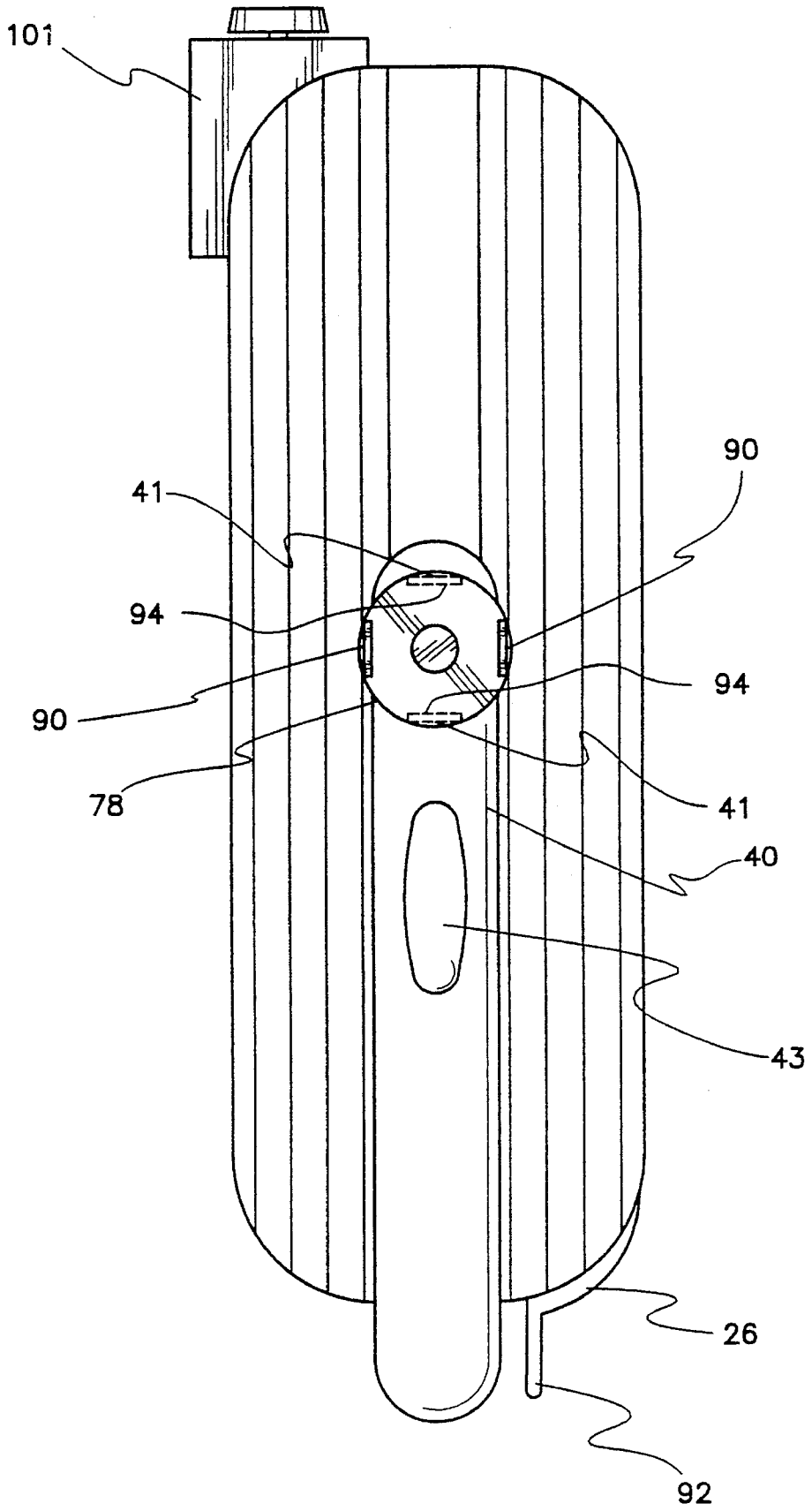
FIG. 3 is a partially cut away side view of the invention showing the tilt limiting mechanisms.

Referring now to FIG. 3 a partially cut-away side view illustrating the tilt limiting mechanisms is shown (the lever 70 and cap 82 of FIG. 2 are cut away to reveal the friction plate 78 underneath). The first mechanism comprises a projection 92 extending from the bottom of the front section 26 of the grill. Different versions of this projection include an extension of the wire-form from the grill; a separate wire-form part added to the grill; and the attachment of a molded or stamped piece of plastic or metal. This projection limits forward tilting.

A pair of projections 90 coming from the friction plate 78 limit rotation of the lever 70. A pair of inward directed projections 94 from the friction plate 78 prevent the friction plate from rotating. They fit into the slots 41 of the support bracket 40.

Another cooperating mechanism for limiting tilt extremes is the position of the control box 101 on top of the fan housing. The control housing 101 protrudes from the top of the unit in such a way that it will be stopped by rearward tilt at approximately 160 degrees when it comes into contact with the U-shaped frame 40.

In operation, to adjust the tilt of the fan housing 16 between the two forward and rearward extremes, the levers 70 of the quick release mechanism 18 seen in FIG. 2 are pivoted outwardly thereby causing pins 54 to move axially inward along the axis of rotation of the fan 16 which in turn causes a corresponding inward movement of the pin 54 thereby reducing pressure on compression member 56 and grill 28 sufficiently to allow rotation of the fan 16 to the desired angle of tilt. Once the fan 16 is positioned as desired the levers 70 can be pivoted inwardly to cause compression member 56 to exert sufficient pressure on the grill 28 to prevent further rotation of the fan 16.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily adapt the tilt limiting mechanisms to other fans or fan assisted heaters.

Furthermore, the levers 70 could be fashioned in various shapes for ease of gripping without altering the cam action.

It is to be understood that the present invention is not limited to the sole embodiment described above, but encompasses any and all embodiments within the scope of the following claims:

I claim:

1. A support for an article comprising:

a U-shaped support bracket having mutually opposing end portions, each of said end portions having central apertures formed therein, means for supporting said support bracket in a vertical position, quick release mechanisms attached to each of said end portions for supporting said article at opposite sides thereof, each of said quick release mechanisms having a lever coupled to a post to effect axial movement thereof, the post extending through said central apertures, a compression member having a central bore axially aligned with said central apertures, said post having a threaded end which projects into and through said central bore, and means secured to said threaded end of said post to effect compression of said compression member in response to axial movement of said post, whereby said quick release mechanisms allow for selective rotation of said article about a horizontal axis.

2. The device of claim 1 wherein said quick release mechanisms can be pivotally moved between first and second positions, said article being free to rotate when the mechanisms are in the first position and being prevented from rotation when said mechanisms are in the second position.

3. The device of claim 1 including means to limit rotation of said article about said horizontal axis.

4. The device of claim 1 wherein said U-shaped support bracket is attached to an oscillatory drive mechanism.

5. The device of claim 1 wherein said compression members are made of an elastomeric material.

6. The device of claim 1 wherein said compression members are comprised of a compression spring.

7. The device of claim 6 wherein said compression spring is a coiled type.

8. The device of claim 6 wherein said compression spring is a flat type.

9. The device of claim 1 wherein said quick release mechanisms can be pivotally moved between two extreme positions, said article being free to rotate when the mechanisms are at one extreme and being prevented from rotation when said mechanisms are at other extreme.

10. The device of claim 3 wherein said means to limit rotation is comprised of a friction plate, said plate having tabs which engage slots formed in said bracket.

11. The device of claim 3 further comprising a fan housing supported at opposite sides thereof by said quick release mechanism, and wherein said means to limit rotation is comprised of a control box protruding from said fan housing which is configured to contact said support bracket.

12. The device of claim 3 further comprising a fan housing supported at opposite sides thereof by said quick release mechanism, and wherein said means to limit rotation is comprised of a material protruding from said fan housing which is configured to contact said support bracket.

13. The device of claim 12 wherein said fan housing includes at least one fan grill, and wherein said material is formed by extending a structural member of the fan grill.

14. The device of claim 12 wherein said material is a separate piece attached to the fan grill.

* * * * *